US006042772A

United States Patent [19]

Miyata et al.

[11] Patent Number: 6,042,772

[45] **Date of Patent: *Mar. 28, 2000**

[54] METHOD OF MANUFACTURING ROLLER STAMP

[75] Inventors: Hiroyasu Miyata; Akihiro Shinohe, both of Tokyo; Masahiro Soma, Fukushima-ken, all of Japan

[73] Assignee: Alps Electric Co., Ltd., Yokohama, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/966,919

[22] Filed: Nov. 10, 1997

[30] Foreign Application Priority Data

Nov. 8, 1996 [JP] Japan ..... 8-313037

[51] Int. Cl.[7] ..... B28B 11/08

[52] U.S. Cl. ..... 264/293; 264/319; 264/321; 425/363; 425/374

[58] Field of Search ..... 425/374, 363, 425/385; 264/293, 299, 319, 320, 321

[56] References Cited

U.S. PATENT DOCUMENTS 5,266,257 11/1993 Kildune ..... 264/293

FOREIGN PATENT DOCUMENTS 07251558 10/1995 Japan .
9-141999A 6/1997 Japan .

*Primary Examiner*—P. W. Echols
*Attorney, Agent, or Firm*—Brinks Hofer Gilson & Lione

[57] ABSTRACT

A roller stamp includes a stamp case and a stamp roller mounted to the stamp case for rotation. The stamp roller is made of foamed polyolefin having pores capable of being impregnated with ink. A stamp pattern is formed on the stamp roller after the stamp roller is mounted to the stamp case. After the stamp roller is mounted to the stamp case, a stamp pattern is formed on the stamp roller by using a thermal head to selectively heat and close the pores in accordance with the stamp pattern.

4 Claims, 2 Drawing Sheets

METHOD OF MANUFACTURING ROLLER STAMP

BACKGROUND OF THE INVENTION

1. Field of the Invention

The present invention relates to a method of manufacturing a roller stamp and, more specifically, to a method of forming a stamp pattern on a stamp roller without using a stamp die after the stamp roller is mounted to a stamp case.

2. Description of the Related Art

Japanese Unexamined Patent Publication No. 3-96383 discloses six conventional methods of forming a stamp pattern on a flat stamp whose stamp surface is made of a porous sponge rubber capable of being impregnated with ink. According to those methods, a stamp pattern is formed on the stamp surface by selectively closing the pores in the stamp surface: (1) applying an adhesive on the stamp surface in accordance with the stamp pattern by means of a screen-printing method; (2) masking the stamp surface in accordance with the stamp pattern, spraying an adhesive on the surface and removing the mask; (3) forming a thermosensitive film on the stamp surface and removing the film in accordance with the stamp pattern by means of a thermal head or heat flashes; (4) applying a thermal transfer film in accordance with the stamp pattern by means of a thermal head or headlashes; (5) heating and melting the stamp surface in accordance with the stamp pattern by means of a thermal head or (6) applying a light-curing resin on the surface and exposing the resin to light in accordance with the stamp pattern.

Japanese Unexamined Patent Publication No. 6-155698 discloses a method of forming a stamp pattern on a flat stamp whose stamp surface is made of a formed polyolefin sheet. According to this method, a stamp pattern is formed on the sheet by heating it in accordance with the pattern.

Further, Japanese Unexamined Patent Publication No. 7-251558 discloses another method of forming a stamp pattern on a flat stamp whose stamp surface is made of an elastic resin sheet. According to this method, a stamp pattern is formed on the sheet by pressing it between a platen and a thermal head. The foamed polyethylene developed by Yamahachi Chemical Co. Ltd. has been found an excellent material for a stamp sheet with which the above methods work very well in manufacturing stamps of the type impregnated with ink. Under all of the methods discussed above, however, a stamp pattern is formed on a foamed thermoplastic resin sheet before the sheet is attached to a flat stamp.

In addition to a flat stamp, there is available a roller stamp capable of continuously carrying out stamping. In manufacturing conventional roller stamps, a stamp pattern is formed by rolling a stamp material on a heated engraved molding die or by forming a pattern on a formed sheet, using the conventional methods discussed above, and winding the sheet around the stamp roller.

As mentioned above, the conventional methods of manufacturing a flat stamp all use a flat sheet, form a stamp pattern on the sheet and then attach the sheet to the flat stamp surface. Thus, according to the conventional methods, a stamp pattern cannot be formed after the flat sheet is attached to the stamp surface. Moreover, a flat stamp requires a large pressing force for stamping. It is difficult to apply a pressing force uniformly to the entire stamp surface of a flat stamp. Thus, an irregular stamp impression is often inescapable.

Generally, a roller stamp does not require a large pressing force upon stamping. An irregular stamp impression rarely occurs with a roller stamp. However, with respect to the roller stamp which requires an engraved molding die to form a stamp pattern, its manufacturing process inevitably includes an additional step of preparing an engraved molding die. Since an engraved molding die determines a stamp mark, an infinite variety of dies would have to be prepared in advance to meet unknown needs of customers, and the stamp pattern cannot be changed at the customer's request.

With respect to the roller stamp in which a stamp pattern is formed on a sheet that is then wound around a roller, its production is cumbersome in that a stamp pattern must be formed on the sheet before it is wound around the stamp roller. Therefore, like the flat stamp discussed above, an infinite variety of stamp sheets would have to be prepared in advance to meet unknown needs of customers, and the stamp pattern cannot be changed at the customer's request.

SUMMARY OF THE INVENTION

To solve the above problem, the present invention provides a novel method of manufacturing a roller stamp. According to the method, before a stamp pattern is formed on a stamp roller but after the roller is mounted to a stamp case, the stamp roller is placed in contact with a thermal head and turned. During one rotation of the roller, energizing pulses are supplied to the thermal head in synchronism with the rotational angle of the roller in order to form a desired stamping pattern on the roller surface.

The present invention also provides an apparatus for forming a stamp pattern on a roller stamp. The apparatus includes a stamp holder for holding a roller stamp with respect to a thermal head while the thermal head is forming a stamp pattern on the stamp roller. The stamp holder may include aligning means for aligning the stamp roller with the heating elements of the thermal head and positioning means for positioning the stamp roller in contact with the thermal head such that the thermal head depresses the surface of the stamp roller by 0.1 mm–0.5 mm. The apparatus further include a driving mechanism. The driving mechanism may include a stepping motor and a gear attached to the stamp roller for transmitting rotational movement from the stepping motor to the stamp roller. The apparatus further includes a controller for energizing the thermal head in synchronism with the rotation of the stamp roller in order to form the stamp pattern on the stamp roller.

The present invention also provides a novel stamp roller. The stamp roller according to the present invention has a cover for use in capping the stamp roller after a stamp pattern is formed on the roller, and the roller is impregnated with ink.

DESCRIPTION OF THE PREFERRED EMBODIMENTS

The preferred embodiments of the present invention will be explained with reference to the accompanying drawings.

Figure 1:
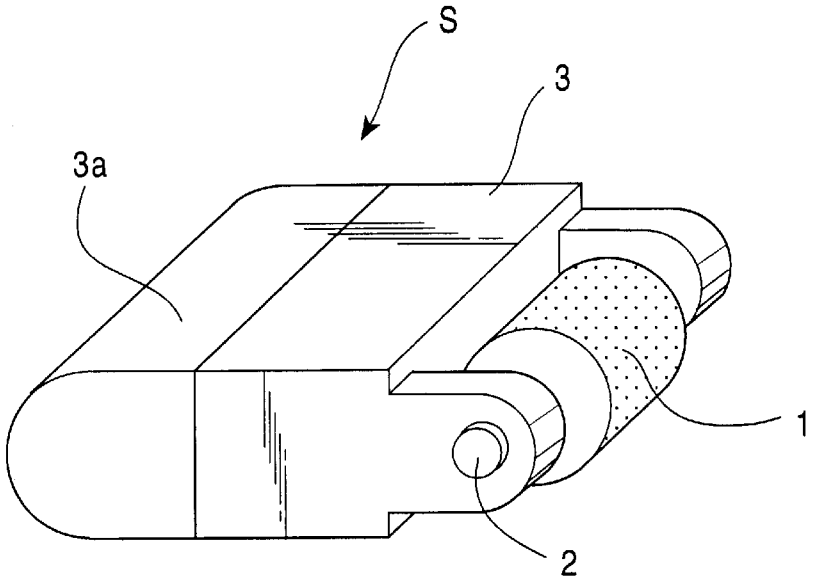
FIG. 1 is a perspective view showing a roller stamp according to the present invention.

FIG. 1 shows a roller stamp S having a porous stamp roller 1 made of foamed polyolefin. The stamp roller 1 is in the shape of a pipe having an inside diameter of 4 mm, an outside diameter of 10 mm, and a length of 15 mm. Force-fitted through the stamp roller 1 is a solid shaft 2 having an outside diameter of 4.4 mm. The solid shaft 2 is rotatably supported by a stamp case 3. No stamp pattern is yet formed on the stamp roller.

Figure 2:
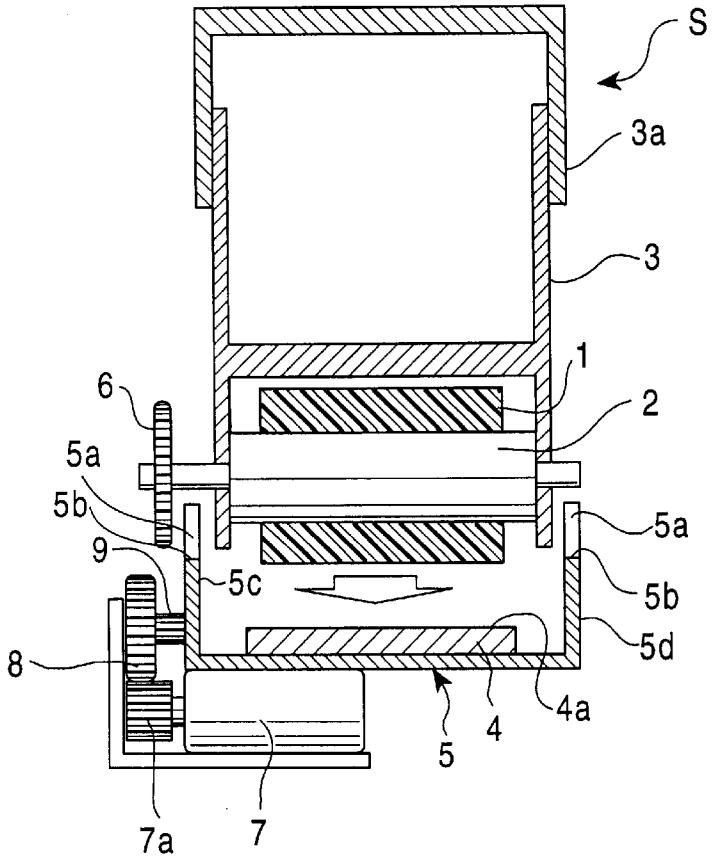
FIG. 2 is a cross-sectional view showing an apparatus for forming a stamp pattern according to the present invention.
Figure 3:
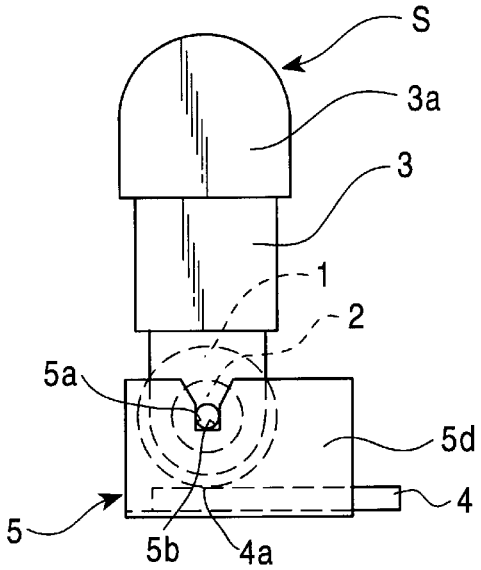
FIG. 3 is a view showing the relative position between the thermal head and the stamp roller while a stamp pattern is formed on the stamp roller by the thermal head.

The method of forming a stamp pattern according to the present invention will be explained with reference to FIGS. 2 and 3. FIG. 2 is a cross sectional view showing an apparatus for forming a stamp pattern according to the present invention. In FIG. 2, the roller stamp S and a thermal head 4 are separated for convenience of illustration. In the figure, the roller stamp S is coming in contact with the thermal head 4. A gear 6 is fixed to the solid shaft 2 forced-fitted through the stamp roller 1. The thermal head 4 has heating elements 4*a* and is fixed to the bottom of a stamp holder 5 that is in the shape of a letter "C" in cross section. Each of the opposing side plates 5*c* and 5*d* of the stamp holder 5 is formed with a notch 5*a* and a stopper 5*b* located at the bottom of the notch 5*a* for defining the relative position between the thermal head 4 and the stamp roller 1. The stamp holder 5 is equipped with a stepping motor 7, a drive gear 7*a* and transmission gears 8 and 9 for rotating the stamp roller 1. FIG. 3 shows the stamp roller 1 being in contact with the thermal head 4 in order to form a stamp pattern on the stamp roller 1. In this figure, the stamp roller 1 is aligned with the thermal head 4. More specifically, the solid shaft 2 is supported and positioned inside the notches 5*a* of the side plates 5*c* and 5*d* so that the stamp roller 1 will be in linear contact with the heating elements 4*a* of the thermal head 4. Moreover, the stoppers 5*b* located at the bottoms of the notches 5*a* position the stamp roller 1 with respect to the thermal head 4 such that the thermal head 4 depresses the surface of the roller 1 by 0.1 mm–0.5 mm. The role of the stoppers 5*b* is particularly important. The heating elements 4*a* of the thermal head 4 melt the surface of the stamp roller 1 to close the pores in the surface. If a head load of the thermal head 4 is imposed on the stamp roller 1 when the surface of the stamp roller 1 is melted, the friction coefficient between the thermal head 4 and the stamp roller 1 will increase, and the melted surface will run and prevent formation of a clear stamp pattern on the stamp roller 1.

In this embodiment, the thermal head 4 and the stamp roller 1 are positioned with respect to each other by means of the notches 5*a* and the stoppers 5*b* formed in the side plates 5*c* and 5*d* of the stamp holder 5. However, other means may be employed for positioning the stamp case 3 with respect to the stamp holder 5.

When the stepping motor 7 rotates while the thermal head 4 is in contact with the stamp roller 1, the stamp roller 1 is rotated through the drive gear 7*a*, the transmission gears 8 and 9, the gear 6 and the solid shaft 2. During one rotation of the stamp roller 1, drive pulses supplied to the stepping motor 7 and energizing pulses supplied to the thermal head 4 are controlled in synchronism in order to form a desired stamp pattern on the stamp roller 1.

Thus, after the roller stamp S bearing no stamp pattern is prepared, the stamp S is placed onto the stamp holder 5. The notches 5*a* align the stamp roller with the heating elements 4*a* of the thermal head 4. The stoppers 5*b* secure the relative position between the thermal head 4 and the stamp roller 1 as shown in FIG. 3. Thereafter, drive pulses are supplied to the stepping motor 7 while energizing pulses are supplied to the thermal head 4. Rotational movement is transmitted to the stamp roller 1 from the stepping motor 7 through the drive gear 7*a*, the transmission gears 8 and 9 and the gear 6. The thermal head 4 selectively heats and closes the pores in the surface of the stamp roller 1 to form a desired stamp pattern on the stamp roller 1. A stamp pattern, i.e., a pattern of supplying the energizing pulses to the thermal head, can freely be selected or changed according to a request from a customer. After the stamp pattern is formed, the roller stamp S is removed from the stamp holder 5. The stamp roller 1 is then impregnated with ink and rolled on a sheet of paper. Ink from pores that are not closed draws the stamp pattern on the paper.

Figure 4:
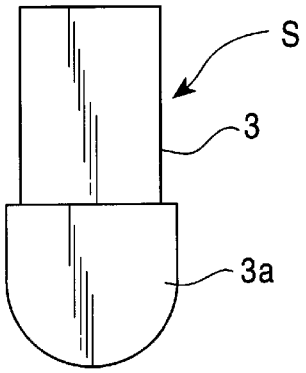
FIG. 4 is a side view showing a roller stamp according to the present invention that has a cover for use in capping the stamp roller.

As shown in FIG. 1, a cover 3*a* is attached to the stamp case 3. The cover 3*a* is removed from the case 3 and used to cap the stamp roller 1 as shown in FIG. 4. The cover 3*a*, when the stamp is not in use, prevents accidental contact with the stamp roller 1 that may cause ink stains and damage the stamp roller surface bearing a stamp pattern. The cover 3*a* is attached to the stamp case 3 when the stamp is manufactured and sold with the roller stamp S. The cover 3*a* may be used for accommodating stamp ink in the stamp case 3.

Figure 5:
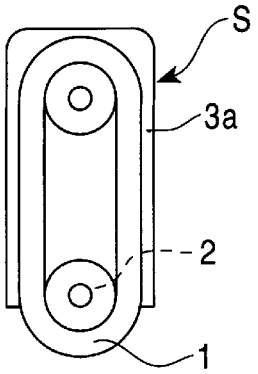
FIG. 5 is a view showing another embodiment of the present invention.

Although the present invention was explained with the preferred embodiment in which the stamp roller is cylindrical, the same effect can be obtained without departing from the scope of the present invention where a belt-shaped stamp roller 1 as shown in FIG. 5 is used.

The method of manufacturing a roller stamp according to the present invention changes the order of the steps of the conventional stamp manufacturing process. According to the manufacturing method of the present invention, since the step of forming a stamp pattern comes at the end of the manufacturing process, roller stamps bearing no stamp pattern can be manufactured as a standard roller stamp in a large quantity, thereby lowering the manufacturing cost. Moreover, the present invention does not use a stamp die. Instead, in the present invention, a stamp pattern is formed by electronically controlling the thermal head and the stepping motor for rotating the stamp roller. It is therefore possible to form not only the same stamp pattern on multiple stamp rollers but also a different stamp pattern on each stamp roller. Also, the thermal head and stepping motor are inexpensive devices.

Experiments show that if the relative position between the thermal head and the stamp roller is adjusted such that the thermal head depresses the surface of the stamp roller by 0.1 mm–0.5 mm, rotation of the stamp roller becomes stable, and the resolution of a stamp pattern can be made as fine as the size of the heating elements of the thermal head. Preferably, the stamp roller is made of foamed polyolefin whose pore sizes are 2 $\mu$m–10 $\mu$m on average and whose melting temperature is 60° C.–140° C. at which the pores are closed by heat from the heating elements of the thermal head. The thermal head may be a thermal head used in a heat transfer printer for transferring ink or a thermal head used in a facsimile for heat sensitive paper. In particular, since a stamp pattern is formed on the stamp roller, the thermal head need not be a special thermal head in which the heating elements are formed at an edge of the head substrate. The thermal head may be an inexpensive thermal head for heat sensitive paper in which the heating elements are formed on a plane.

According to the manufacturing method of the present invention, since a stamp pattern is formed after the stamp is manufactured, the manufacturing process is simplified, and the same stamps can be manufactured in a large quantity, thereby lowering the manufacturing cost. Further, the apparatus for forming a stamp pattern according to the present invention may include an inexpensive printing device, such as a printer for personal computers, a printer for word processors, a postcard printer, etc., which uses a thermal head to print characters and pictures. Therefore, the stamp pattern forming apparatus may be placed at shops selling the rollers stamps, or customers may buy the apparatus for personal use. An automatic vending machine for selling the roller stamps may be made on which customers can freely select their desired stamp patterns or input their names to be formed on stamp rollers. Thus, the present invention has an excellent advantage that a stamp pattern can be selected by a customer or changed at the customer's request.

What is claimed is:

1. A method of manufacturing a roller stamp comprised of a stamp case and a stamp roller, said method comprising the steps of:

providing said stamp roller formed of a foamed thermoplastic resin having continuous pores, said stamp roller having a circumferential surface bearing no stamp pattern;

mounting said stamp roller to said stamp case for rotation;

positioning said stamp case relative to a thermal head so that said stamp roller being mounted on said stamp case will come in contact with said thermal head; and forming a desired stamp pattern on the circumferential surface of said stamp roller with said thermal head while rotating said stamp roller held in contact with said thermal head.

2. A method of manufacturing a roller stamp according to claim 1, wherein said stamp roller is made of foamed polyolefin having pores capable of being impregnated with ink, and said thermal head selectively heats and closes said pores in accordance with said desired stamp pattern.

3. A method of manufacturing a roller stamp according to claim 1, said step of forming a desired stamp pattern further including the steps of:

rotating said stamp roller held in contact with said thermal head; and energizing said thermal head in synchronism with the rotation of said stamp roller to selectively heat and close said pores in the circumferential surface of said stamp roller in order to form said desired stamp pattern on the circumferential surface of said stamp roller.

4. A method of manufacturing a roller stamp according to claim 1, wherein the relative position between said stamp roller and said thermal head is adjusted such that said thermal head depresses the circumferential surface of said stamp roller by 0.1 mm–0.5 mm.

* * * * *